United States Patent [19]

Smith

[11] 4,441,805

[45] Apr. 10, 1984

[54] MEANS FOR POSITIONING OPTICAL COMPONENTS FOR A VARIABLE MAGNIFICATION/REDUCTION COPIER OPTICS SYSTEM

[75] Inventor: Gerald L. Smith, Broomfield, Colo.

[73] Assignee: International Business Machines Corporation, Armonk, N.Y.

[21] Appl. No.: 392,864

[22] Filed: Jun. 28, 1982

[51] Int. Cl.[3] ..... G03G 15/28

[52] U.S. Cl. ..... 355/14 R; 355/8; 355/55; 355/77

[58] Field of Search ..... 355/14 R, 8, 3 R, 11, 355/55–57, 60, 66, 77

[56] References Cited

U.S. PATENT DOCUMENTS 3,918,806 11/1975 Cook ..... 355/8

4,332,461 6/1982 Cail et al. ..... 355/8 X

*Primary Examiner*—R. L. Moses

*Attorney, Agent, or Firm*—Charles E. Rohrer

[57] ABSTRACT

A continuously variable magnification/reduction scanning optical system for a document copier machine where the lens and total conjugate length adjustment are made prior to the copy operation without use of a special optics positioning motor. Optical component adjustment is achieved through use of the scan drive motor by coupling the scan carriage to the lens carriage during the set-up period and uncoupling the carriages during normal operation.

16 Claims, 10 Drawing Figures

MEANS FOR POSITIONING OPTICAL COMPONENTS FOR A VARIABLE MAGNIFICATION/REDUCTION COPIER OPTICS SYSTEM

This invention relates to variable magnification/reduction copier optics and more particularly to means for positioning the lens and other optical components to achieve magnification/reduction in the optical system.

BACKGROUND OF THE INVENTION

In variable magnification/reduction optical systems for use in document copier machines, either a zoom lens or a fixed focused lens can be used. In order to achieve the required magnification/reduction ratio, such a lens must be positioned prior to the copy operation in order to achieve the required reduction or magnification. In addition, the total conjugate length (TCL) must be altered in order to retain focal sharpness at the image plane. In many machines, the TCL adjustment is accomplished by changing the length of the optical path by altering the position of mirrors in that path. In operation, both the lens and TCL adjustments must be accomplished prior to beginning the copy operation. Other parameters must also be adjusted as fully described in U.S. Pat. No. 4,120,578 and 4,209,248 which patents describe continuously variable scanning reduction systems utilizing a mechanical drive.

U.S. Pat. No. 4,287,461 describes a continuously variable scanning reduction system for the optics of a document copier machine in which the mechanical drive of the above-named patents is replaced by a servo system in which the scanning optical components are driven by a scan drive motor separate from the main drive motor. In that system there is no direct mechanical connection between the scan components and the photo-receptive drum.

In all of the above-named patents, the initial optical setup is achieved through an optics positioning motor which positions the lens and other optical components in response to the desired reduction or magnification ratio selected by the machine operator. It is the general object of this invention to provide an optics positioning system which eliminates the need for a special optics positioning motor.

SUMMARY OF THE INVENTION

Briefly stated, this invention relates to a variable magnification/reduction optical system for a document copier machine and proyides means for positioning the lens and providing for total conjugate length adjustment by utilizing a disconnectable coupling to connect a drive motor used during normal copy production to position the lens and total conjugate length mechanisms prior to normal copy production.

In a particular embodiment, a first scanning carriage carries illumination means and a first scanning mirror to traverse the length of a document to be copied. A second scanning carriage carries a double mirror to receive reflected light rays from the first scanning carriage and redirect them through a lens to a fourth fixed mirror which directs the light rays to the photo-receptive surface. In this embodiment, an actuating mechanism is placed on the lens carriage or on either one of the two scanning carriages so that when positioning the copier optics prior to scan, the actuating mechanism is energized to extend a mechanical arm. As the carriages slowly move across the document glass, the mechanism arm couples one of the two scanning carriages to the lens carriage resulting in the movement of the lens carriage. The lens carriage is connected to total conjugate length adjustment mechanisms so that the relative position of the scanning carriages is altered to achieve that adjustment congruently with the repositioning of the lens. After the initial setup is complete, the actuating mechanism is deenergized to retract the mechanism arm out of the path of the scanning carriage so that the normal scanning operation proceeds without further movement of the lens and total conjugate length adjustment mechanisms.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
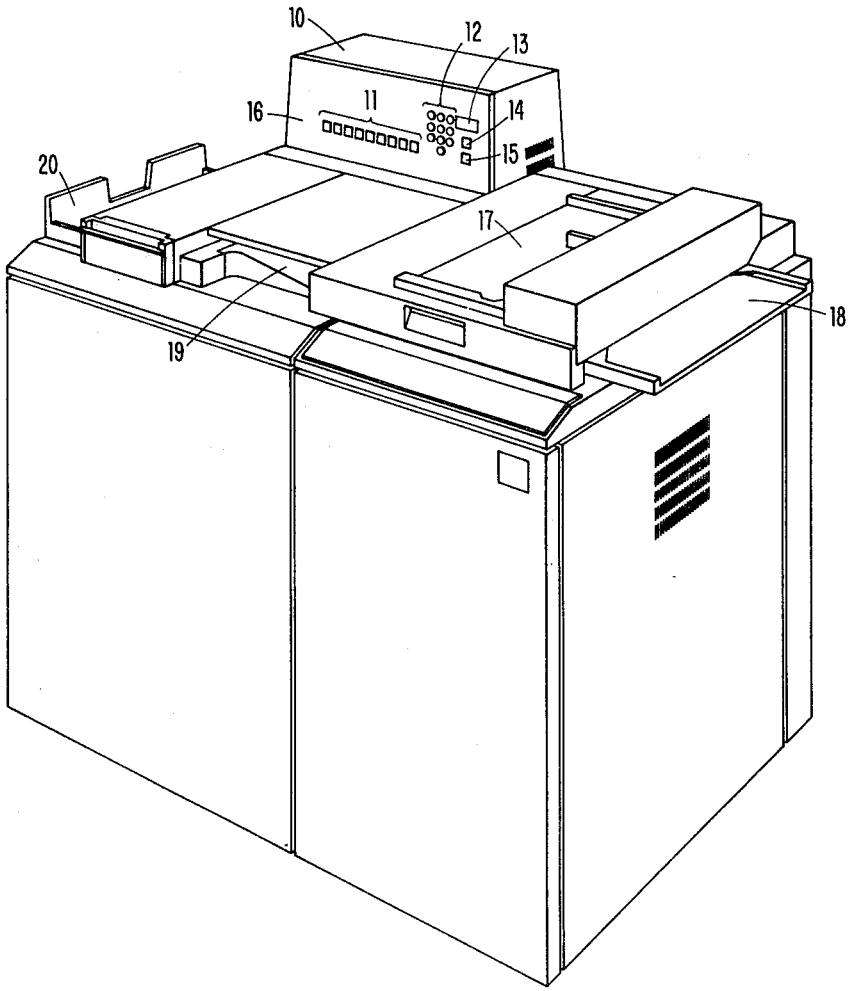
FIG. 1 shows a perspective view of a document copier machine which may incorporate the instant invention.

FIG. 1 is a perspective view of the exterior of a typical electrophotographic copier machine. The device incorporates a control tower 10 with several keys 11 for selecting various functions appropriate to a particular job. For example, the keys 11 may incorporate a reduction function, a light copy function, a dark copy function, etc. The ten keys 12 are numerical keys for keying into the machine a number which ordinarily indicates the number of copies to be made. However, in some modes of operation, for example, modes of operation special to maintenance personnel, these keys may be used to instruct the microprocessor controlled machine to automatically perform various operations for assistance in maintenance procedures. Hereinafter, a description will be provided below as to how these keys 12 may be used to instruct the machine to move the optics to a particular magnification or reduction ratio. The area 13 indicates the number which has been keyed into the machine at 12. A start button 14 and a stop/reset button 15 are also located on the control tower. Finally, the area 16 is used for various kinds of error messages.

The machine shown in FIG. 1 incorporates an automatic document feed mechanism including a tray 17 onto which stacks of documents may be placed for automatically feeding them one at a time onto the document glass. The machine also incorporates a semiautomatic document feed with a tray 18 onto which documents may be placed one at a time for feeding them onto the document glass. Original documents exit into an area 19 while completed copies exit the machine into holding tray 20.

Figure 2:
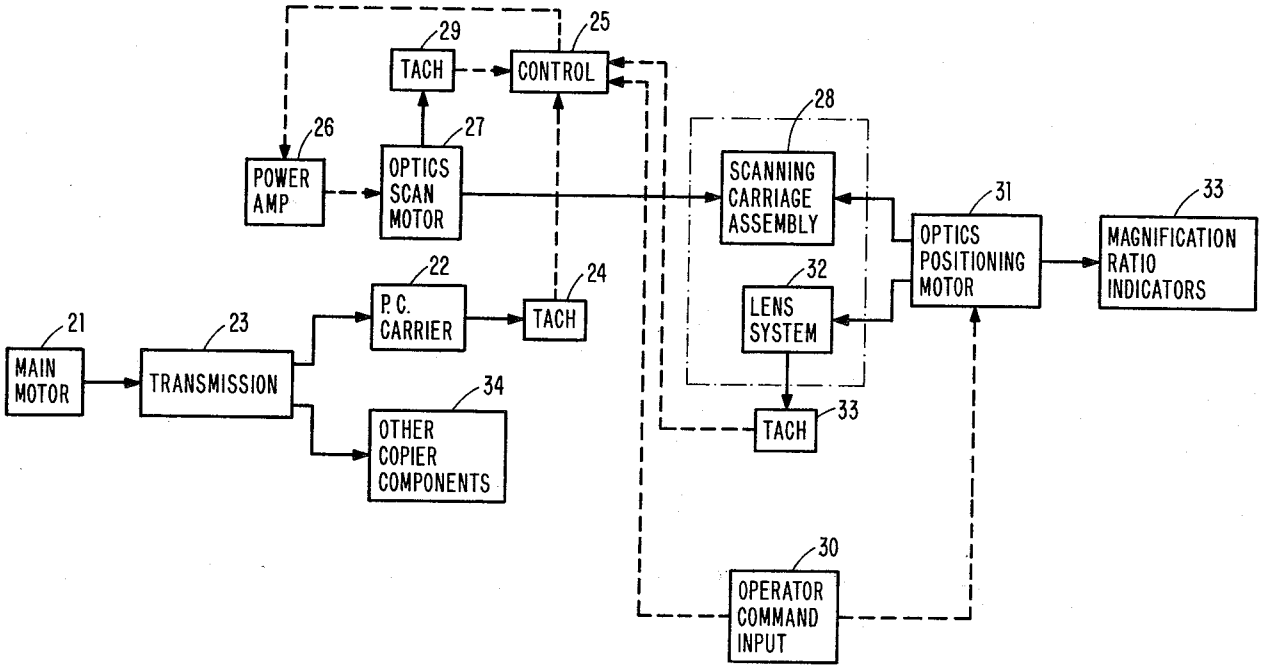
FIG. 2 PRIOR ART
FIG. 2 is a schematic diagram of prior art drive and optics positioning systems.

FIG. 2 is a block diagram showing a prior art representation of a continuously variable optics system. This particular diagram illustrates the optical system of above-mentioned U.S. Pat. No. 4,287,461 and represents an optical system embodiment which is improved by the instant invention.

FIG. 2 shows that a main motor 21 drives the photoconductor carrier 22 through a transmission 23. FIG. 2 shows that the speed of the photoconductor carrier is sensed by a tachometer 24 and that this speed information is sent to the central control unit 25. In viewing this diagram, note that mechanical couplings have been illustrated in solid lines while electrical couplings are illustrated with broken lines.

In order to drive the scanning carriage assembly 28 in synchronism with the photoconductor carrier 22, the control unit 25 utilizes the speed information received from tachometer 24 to cause the power amplifier 26 to supply the needed power to the optics scan motor 27 so that the scanning carriage assembly 28 is driven at the proper speed. The speed of the scanning carriage assembly 28 is monitored by a scan tach 29 connected to the optics scan motor 27. Scan tach 29 sends acceleration, velocity, and deceleration information back to the control unit 25 which then calculates the position of the scan carriages, if necessary.

The FIG. 2 system is for a continuously variable reduction optical system in which the machine operator sets the reduction ratio 30. This information is sent to the central control unit 25 and to the optics positioning motor 31 for positioning the lens 32 at a position appropriate for the reduction ratio commanded by the operator. The optics positioning motor 31 also adjusts the scanning carriage assembly 28 in order that total conjugate length correction can be carried out. In the particular system shown in FIG. 2, the optics positioning motor also operates magnification ratio indicators 33 for informing the operator when the proper magnification ratio has been reached. The lens position tachometer 33 feeds information concerning the position of the lens 32 to the control unit 25 so that when the lens reaches a position satisfactory to the operator (as shown to him by the ratio indicators 33), the central control system has an indication of the final ratio.

It may be observed that main motor 21 drives several other copier components 34 through transmission 23.

Figure 3:
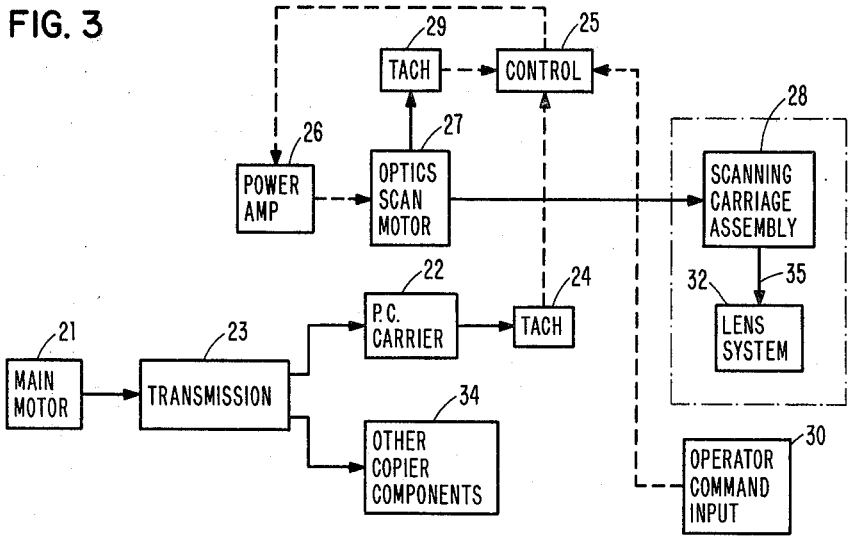
FIG. 3 is a schematic diagram of the drive and optics positioning systems of this invention.

FIG. 3 is identical to FIG. 2 except that it shows how the optical system is simplified through incorporation of the instant invention. Note that in this case, the operator command input 30 is sent to the central control unit 25 and in the optics positioning initial setup, control unit 25 causes the power amplifier 26 to drive the optics scan motor 27 at a very slow speed to move the scanning carriage assembly 28 through a scanning operation. During this initial setup period, a coupling 35 is operated so that when the scanning carriage assembly reaches the lens system 32, it gently moves the lens to its proper position as called for by the operator command input 30. At this point in the movement of the scanning carriage assembly 28, the coupling 35 is removed so that the lens 32 is moved no further than called for by the input 30. In this system, the lens is moved in either direction by the scanning carriage assembly 28 through coupling 35.

Position of the lens 32 is sensed through the tachometer 29 which feeds back to the control unit 25 information representative of the position of the scanning carriage assembly as well as acceleration, speed and deceleration information. By feeding back such information, the position of lens 32 is known to control unit 25. In that manner, the control unit issues a signal to release coupling 35 at the correct instant to provide positioning of the lens in accordance with the operator's command. By mechanical connections to be shown subsequently, the lens system 32 is connected to the scanning carriage assembly so that when the lens is positioned, the relative position of the two scanning carriages is changed in order to adjust total conjugate length simultaneously with positioning of the lens system 32.

Figure 4:
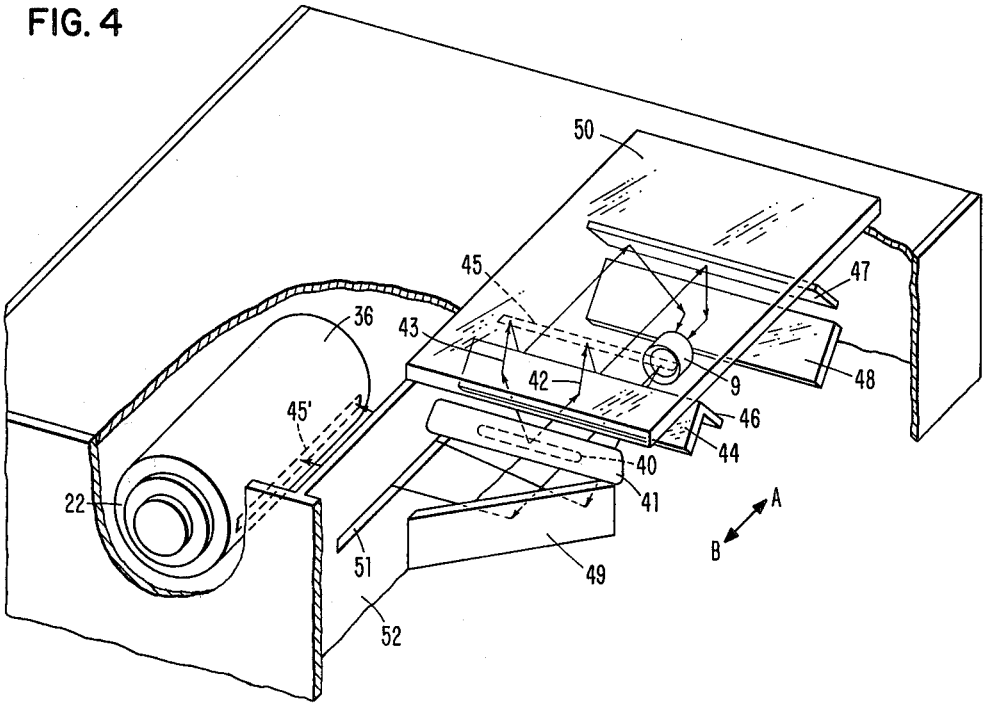
FIG. 4 is a perspective view of an optics module which may be used in the machine shown in FIG. 1 and which may incorporate the instant invention.

FIG. 4 illustrates a typical optical system which may be employed in an electrophotographic copier machine such as that shown in FIG. 1. In FIG. 4, photoreceptive material 36 is shown mounted on photoconductor carrier 22. A document glass is shown at 50 upon which a document to be copied is placed. In order to copy that document, a light source 40 encased in a reflector 41 generates rays of light which are represented at 42 and 43 and which are reflected from dichroic mirror 44 onto the document glass 50. Representative rays of light 42 and 43 together with other rays of light from light source 40 form a line of irradiation 45 at document glass 50. The line of irradiation 45 is reflected from a document positioned on glass 50 to mirror 46, and from there to the double mirrors 47 and 48, through the lens 9, to fixed mirror 49, and from there to form a line of irradiation 45' on the surface of photoreceptor 36. By moving the line of irradiation 45 in scan direction A across the document positioned on the document glass 50, and simultaneously moving line 45' across the photoreceptive surface 36 through movement of carrier 22, a reflective duplicate of a document to be copied is caused to appear on the photoreceptive surface. If the speed of the photoreceptive surface 36 is equal to the speed at which the line of irradiation 45 scans the document, a 1:1 copy of the document is produced on photoreceptive surface 36. If the scanning line 45 is caused to move faster than line 45', the result is a reduced copy of a document placed on glass 50 assuming that an appropriate change in the lens position and TCL position has occurred. Conversely, if the scanning line of irradiation 45 is moved more slowly than the duplicate line of irradiation 45', the result is a magnification of the document located on glass 50, again assuming that the optical system has been properly initialized.

Figure 5:
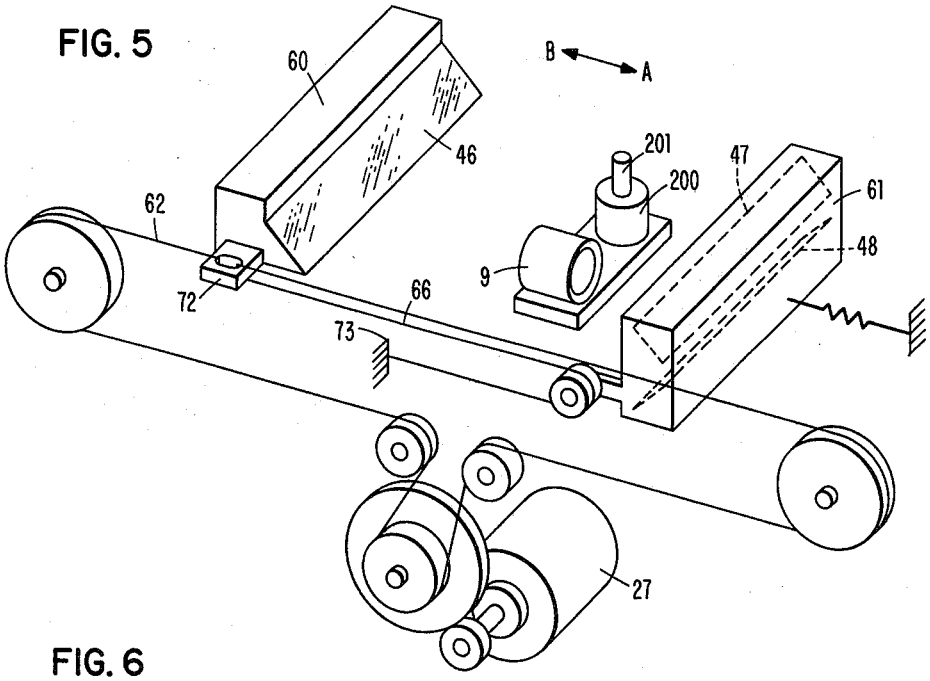
FIG. 5 shows the scan drive components used in the module of FIG. 4 with optics positioning components added to incorporate the instant invention.

FIG. 5 shows the scanning mechanism employed in U.S. Pat. No. 4,287,461. The optics scan motor 27 drives cable 62 which is attached to the first scanning carriage 60 and thereby moves carriage 60 in scan direction B or rescan direction A. The second scanning carriage 61 is attached to the first scanning carriage through cable 66, and thereby is moved with carriage 60. The drive coupling arrangement is such that the first scan carriage 60 scans at twice the speed of second scan carriage 61. Note that cable 66 is terminated at a mechanical ground point 73, which point is moved in order to change the relative position of the two scanning carriages for TCL adjustment. It may be noted that scan carriage 60 carries various components shown in FIG. 4 including the illumination source 40, the dichroic mirror 44 and the first optics path mirror 46. Second scanning carriage 61 carries the dual mirrors 47 and 48 shown in FIG. 4.

FIG. 5 also shows the actuating mechanism of this invention mounted on the lens carriage. A solenoid 200 operates actuating arm 201 to extend that arm so that when carriage 60 passes over lens 9, the arm 201 comes into contact with the lens carriage and moves lens 9. Direction of movement of the lens can occur in either direction A or direction B.

Figure 6:
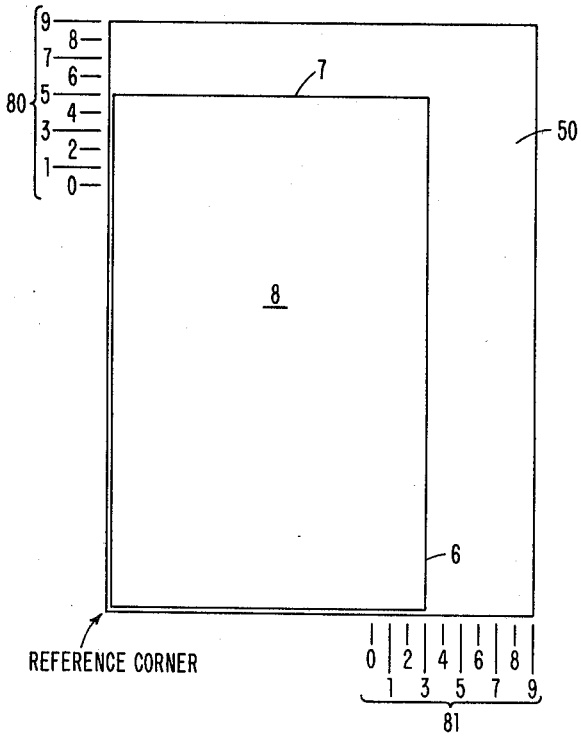
FIG. 6 is a top view of the document glass of the machine of FIG. 1 with magnification/reduction scales to incorporate the instant invention.

FIG. 6 illustrates a positioning of a document 8 on document glass 50 and shows a first set of indicators 80 positioned along one side of document glass 50 and a second set of indicators 81 positioned along a second side of document glass 50. In the particular embodiment chosen for illustration, document 8 is corner referenced on the glass 50 and the numbers in scale 80 represent an indication of the position of the edge 7 of document 8 along that side of the document glass. Similarly, the numbers in scale 81 indicate the position of edge 6 of document 8 along another side of the document glass.

In operation, the scales 80 and 81 provide a method for setting the proper magnification/reduction ratio in the copier machine. The method calls for placing the original on the document glass as shown, observing the scales 80 and 81, and keying the larger number corresponding to the size of the original into the machine. The control unit 25, incorporating a microprocessor, then establishes a ratio consistent with copy paper size and commands the optics adjustment mechanisms to provide the ratio.

FIG. 6 shows that the original document 8 is corner referenced upon the document glass 50 and that a setting of "5" is required in order to completely encompass the original 8 onto copy paper. The operator arrives at this judgement since the edge 7 extends to the numerial "5" on the scale 80. Note that the edge 6 of original 8 extends only to the numeral "3" on scale 81. Had the reading on scale 81 been larger than the reading on scale 80, the operator would choose the larger scale 81 reading. In all cases, the operator chooses the larger reading in order to encompass all of the original document on the copy sheet and keys that reading through keyboard 12 (FIG. 1) into the central control unit 25.

Figure 7:
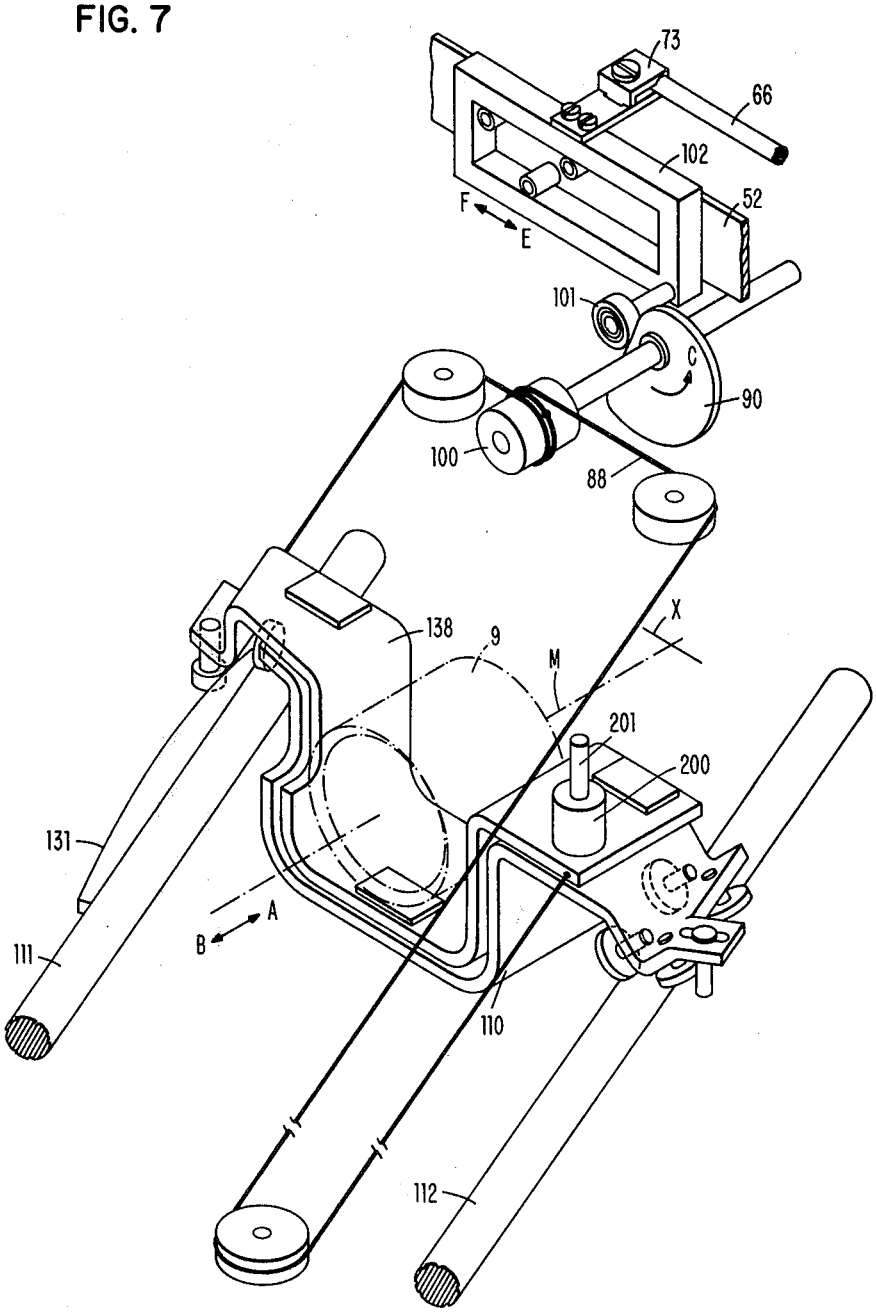
FIG. 7 is a perspective view of the lens and TCL adjustment mechanisms.

FIG. 7 shows a detailed view of the lens carriage for moving the lens 9 back and forth along rails 111 and 112. FIG. 7 also shows the total conjugate length adjustment mechanism connected through cable 88 to the lens carriage.

As already discussed in regard to FIG. 5, when arm 201 is extended, it drops into position to move the lens 9 in, for example, direction A. In FIG. 7, direction A is shown as a direction parallel to the optical axis M of lens 9. Actual movement of the lens 9 supported in the double lens carriage 110 and 138 is along the rails 111 and 112 which are positioned at an angle to optical axis M in this embodiment which involves a corner referenced original as shown in FIG. 6. The double carriage is needed because compound motion is required to meet an objective of keeping the image of the corner referenced document of FIG. 6 in constant position on the photoreceptive surface throughout a continuously variable range of magnification or reduction ratios. That compound motion is provided by cam 131 and the double carriage structure.

As the lens carriages are moved along the rails in direction B, the cable 88 causes a rotation of pulley 100 and cam 90 in direction C. Cam follower 101 follows cam 90 and causes a translation of truck 102 in direction F. Since scanning cable 66 is tied to ground point 73 as shown in FIG. 5 as well as in FIG. 7, the shifting of truck 102 causes a shifting of the ground point 73 and referring to FIG. 5, it can be observed that as ground point 73 shifts, the relative positions of the first carriage 60 and the second carriage 61 shift, thus altering the length of the optical path. By providing the correct shape to cam 90, this adjustment of the length of the optical path is caused to follow in a continuous manner the adjustment of lens position 9 thus adjusting the total conjugate length to maintain focal sharpness as various reduction or magnification ratios are reached.

While many optical systems possess sufficient friction to stay in position once the correct lens and TCL position have been reached, it may be desirable to set a brake. This may be accomplished by attaching a friction shoe to the actuating arm 201 and spring loading the arm so that the shoe is set against a friction plate when the solenoid 200 is deenergized. The friction plate may be one of the rails 111 or 112 or the floor under the rails.

Figure 8:
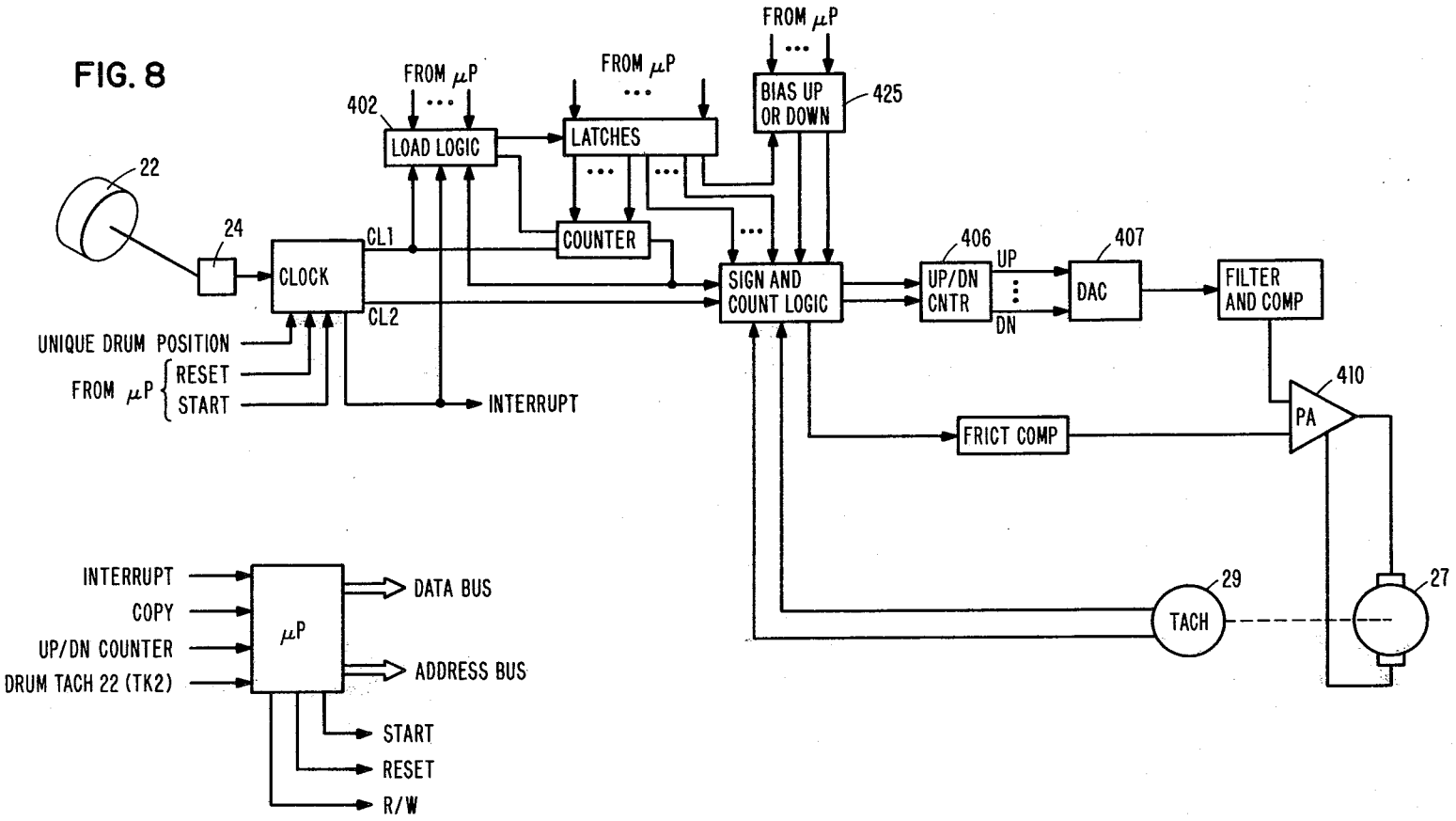
FIG. 8 illustrates the control logic for the machine of FIG. 1.

As previously mentioned, the electrical operation of the servo drive system of the embodiment shown is fully described in U.S. Pat. No. 4,287,461 and reference may be made to that case for a complete description of the entire system. FIG. 8 herein is a duplicate of FIG. 6 of that patent and shows control input from a microprocessor to generate signals which are supplied through the normal scanning load logic 402 to an up-down counter 406. Those signals are then transformed into an analog by digital-to-analog converter 407 for driving the scan motor 27. Feedback signals from the scan tachometer 29 drive the up-down counter 406 so that the numerical differential between the drive signal and the feedback signal can be kept at a desired value which may be a constant, for example, during a constant speed operation of the scanning carriages. If desired, control input from the microprocessor can be supplied through a bias up or down logic 425 directly to the up-down counter 406 and this control path is preferably used for very slow speed operation of the scanning motor 27 for the instant invention as well as for the bias home operation shown in FIG. 18B of U.S. Pat. No. 4,287,461 which is duplicated as FIG. 9 herein.

Figure 9:
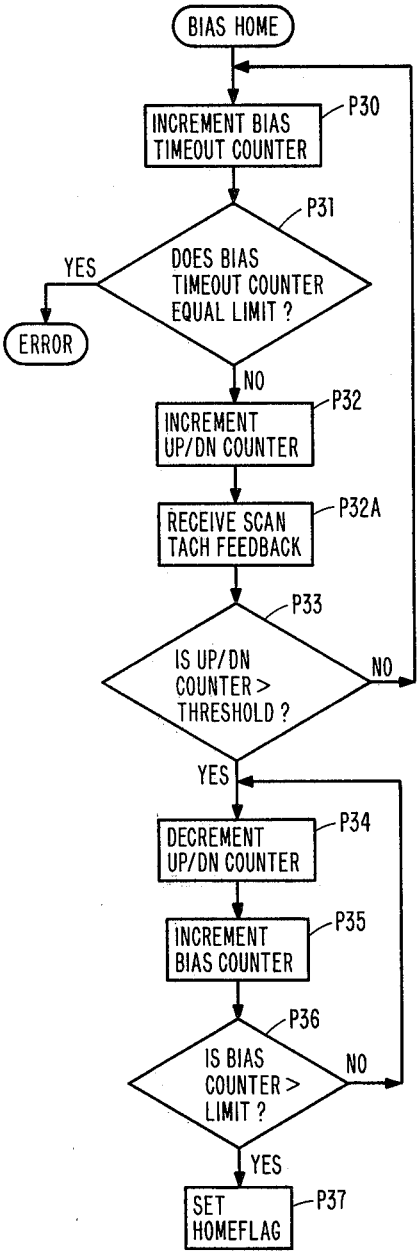
FIG. 9 shows a positioning procedure for initializing scan carriage position.

FIG. 9 shows the bias home operation which is essentially a process which moves the scanning carriages very slowly toward the home position upon power-up, for example, when the position of the carriages is unknown to the central control unit 25. By moving the carriages gently into the home stop, feedback signals from the scan tachometer 29 drop to zero. In that manner, the microprocessor becomes aware of the exact position of the scanning carriages and from there can keep track of the position of the carriages throughout their operation. In FIG. 9, microprocessor input causes a timeout counter and the up-down counter 406 to be incremented at steps P30 and P32 causing the carriages to move toward home position. The count on counter P30 is compared to a limit at step P31, and if the limit is exceeded, the loop is exited and an error message is enabled indicating a failure to home the carriages. In normal operation, the limit is not exceeded and the count in the up-down counter 406 is queried at step P33.

Should that count be low, as expected, the indication is that the carriages are slowly moving toward home position. Note that motion of the carriages causes a decrement of the up-down counter due to feedback from scan tachometer 29 as shown at step P32A. Thus the count at step P33 is low as the movement toward home proceeds. However, once the home stop is reached, decrementing signals from the scan tachometer 29 cease and the count in counter 406 rises to reach a threshhold and cause a branch to step P34. The concluding steps P34–P37 merely reset the counter 406 and set a home flag to indicate carriage home position to the microprocessor.

Figure 10:
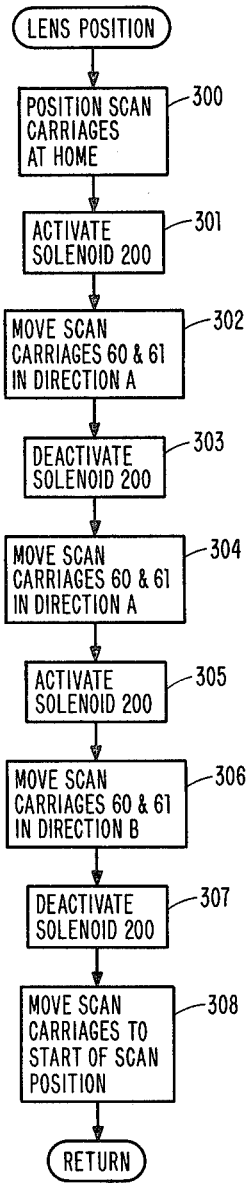
FIG. 10 shows a procedure for initializing lens position and/or adjusting lens position.

Although the position of the scan carriages has been established, the position of the lens may still be unknown to the microprocessor. FIG. 10 illustrates the lens positioning procedure which is used to establish lens position and to alter lens position to adjust for a commanded reduction ratio. After the position of the scanning carriages at the home position is reached at 300, the solenoid 200 is activated to drop solenoid arm 201 into position to move the lens carriage upon energization of the scan motor 27. At step 302, the scan motor is energized to move the scanning carriages 60 and 61 at a slow speed along the scan path. At some point during that travel, the arm 201 comes into contact with the lens carriages and moves the lens to the maximum magnification position. That position will be known to the central control unit by virtue of the fact that the scanning carriages began at a known position and the amount of travel from that known position (home) is known through feedback from the scan tachometer 29. When the maximum magnification position is reached (or reduction position depending on the optical system), the solenoid 200 is deactivated as shown at step 303. With the lens now in a known position, the scanning carriages continue their movement until the solenoid is on the other side of the lens carriage at step 304. Next, at step 305, the solenoid 200 is again activated and at step 306, the scan carriages 60 and 61 are moved in direction B. The result is to move the lens carriage to a desired magnification/reduction position at which time the solenoid is deactivated at step 307. Upon machine startup, for example, the desired position may be at a 1:1 reduction ratio. To complete the operation of FIG. 8, the scanning carriages are moved to the start of scan position at step 308 and a return is made to the microprocessor for the next copier operation.

FIG. 10 shows the determination of lens position upon machine start-up when the position of the lens is unknown. At other times during the course of a day's operation, for example, when an operator requests a particular reduction or magnification ratio, it is unnecessary to move the scanning carriages into a home position since the position of both the scanning carriages and the lens carriage will be known to the central control unit. Consequently, the procedure shown in FIG. 10 is altered to the extent that the solenoid 200 is activated at either a start-of-scan position or an end-of-scan position in order to move the lens in either a reduction direction or a magnification direction as called for by the change in reduction ratio.

Various changes can be made in the system described in the preferred embodiment and many other embodiments of this invention can be visualized. For example, the size of the original could be automatically sensed in order to command the processor to provide appropriate magnification/reduction ratios. A variable focus lens rather than a fixed focus lens could be used and appropriate adjusting mechanisms provided to couple the variable focus lens adjustment to the scanning carriage during a setup period. Single edge reference machines can profitably use this invention as can machines with discrete reduction or magnification ratios. Machines with a direct mechanical drive to the scanning system can also use this invention by providing appropriate speed reduction when the scanning carriage is coupled to the lens. The invention can be used with moving document copiers or with scanning lens systems or with full frame flash exposure systems where the coupling is made to some other drive motor, one within the paper path, for example. Obviously, if desired, a stepper motor could be used in any of these applications instead of the dc series motor with a position encoder disclosed in the preferred embodiment.

While the invention has been particulary shown and described with reference to a preferred embodiment thereof, it will be understood by those skilled in the art that the foregoing and other changes in form and details may be made therein without departing from the spirit and scope of the invention.

What is claimed is:

1. A variable reduction optical system for use with a document copier machine comprising:

a drive motor means for driving machine components during copy reproduction;

a lens assembly; and an optics positioning system for use in altering the position of said lens in order to achieve a selected reduction ratio, said positioning system including disconnectable coupling means for connecting said lens assembly and said drive motor means for altering the position of said lens in response to rotation of said drive motor means, the connection provided by said coupling means being removed for the normal copying operation.

2. The system of claim 1 further including:

total conjugate length adjustment mechanisms, said mechanisms connected to said lens assembly for adjusting total conjugate length simultaneously with an alteration in the position of said lens.

3. The system of claim 2 wherein said optics positioning system is a substantially continuously variable positioning system.

4. The system of claim 2 further comprising:

a document glass;

a scanning optical system with at least one scanning carriage; and said drive motor means driving said scanning carriage, said coupling means mounted to couple said scanning carriage to said lens assembly.

5. The system of claim 4 further comprising:

control means, including a processor, for providing signals to cause said drive motor to drive said scanning carriage at a selected speed for altering the position of said lens; and said control means also providing signals to place said coupling means in a connecting relationship with said lens assembly.

6. The system of claim 5 wherein said optics positioning system is a substantially continuously variable positioning system.

7. The system of claim 5 wherein said drive motor is a servo scan motor, said optics positioning system further including:

a digital scan tachometer connected to said scanning carriage and to said processor for providing feedback information relating to the velocity and position of said scanning carriage.

8. The system of claim 7 wherein said optics positioning system is a substantially continuously variable positioning system.

9. A document copier machine comprising:

a document glass;

a photoreceptive surface mounted on a drum;

a main drive motor for rotating said drum;

an optics module for transmitting irradiation reflected from a document to be copied placed on said document glass to said photoreceptive surface;

said optics module containing a lens assembly and at least one scanning carriage driven by a scan drive motor for scanning said document to be copied;

command station means for commanding said machine to produce a copy of said document at a reduction ratio;

control means for receiving said command for signaling said scan drive motor to move said scanning carriage at a speed suitable for positioning said lens assembly at a position consonant with said reduction ratio; and coupling means, operated under control of said control means, for connecting said scanning carriage and said lens assembly during the positioning operation and operating said coupling to disconnect said scanning carriage and said lens assembly during the document scanning operation.

10. The machine of claim 9 further including:

total conjugate length adjustment mechanisms, said mechanisms connected to said lens assembly for adjusting total conjugate length simultaneously with an alteration in the position of said lens.

11. The machine of claim 10 wherein said optics positioning system is a substantially continuously variable positioning system.

12. The machine of claim 10 wherein said control means includes a processor for providing signals for placing said coupling means in a connecting relationship with said lens assembly.

13. The machine of claim 12 wherein said scan drive motor is a servo motor, said optics positioning system further including:

a digital scan tachometer connected to said scanning carriage and to said processor for providing feedback information relating to the velocity and position of said scanning carriage.

14. The machine of claim 13 wherein said optics positioning system is a substantially continuously variable positioning system.

15. A method of repositioning a lens assembly in a magnification/reduction optical system for use with a document copier machine comprising the steps of:

(1) placing a disconnectable coupling into a first state for connecting said lens assembly with a drive motor;

(2) operating said drive motor to move said lens assembly to a position consonant with a selected reduction ratio;

(3) placing said disconnectable coupling into a second state for disconnecting said lens assembly from said drive motor; and (4) producing a copy at said magnification/reduction ratio.

16. The method of claim 15 wherein said step of operating said drive motor to move said lens positions said lens in a substantially continuously variable manner.

* * * * *